US010906683B2

(12) United States Patent
Zeuschner

(10) Patent No.: US 10,906,683 B2
(45) Date of Patent: Feb. 2, 2021

(54) CROSS-CUTTING DEVICE

(71) Applicant: Hochland SE, Heimenkirch (DE)

(72) Inventor: Roland Zeuschner, Argenbuhl (DE)

(73) Assignee: Hochland SE, Heimenkirch (DE)

( * ) Notice: Subject to any disclaimer, the term of this patent is extended or adjusted under 35 U.S.C. 154(b) by 209 days.

(21) Appl. No.: 15/495,123

(22) Filed: Apr. 24, 2017

(65) Prior Publication Data

US 2017/0225817 A1 Aug. 10, 2017

Related U.S. Application Data

(60) Division of application No. 14/284,827, filed on May 22, 2014, now abandoned, which is a division of application No. 12/532,713, filed as application No. PCT/EP2008/052934 on Mar. 12, 2008, now abandoned, said application No. 14/284,827 is a continuation of application No. 14/532,713, filed on Sep. 23, 2009, now abandoned.

(30) Foreign Application Priority Data

Mar. 29, 2007 (DE) ..... 10 2007 015 624

(51) Int. Cl.

| | |
|---|---|
| ***B65B 61/10*** | (2006.01) |
| ***B26D 1/62*** | (2006.01) |
| ***B26D 7/10*** | (2006.01) |

(52) U.S. Cl.

CPC ..... *B65B 61/10* (2013.01); *B26D 1/626* (2013.01); *B26D 7/10* (2013.01); *Y10T 83/04* (2015.04); *Y10T 83/293* (2015.04); *Y10T 83/4838* (2015.04); *Y10T 83/4844* (2015.04)

(58) Field of Classification Search

CPC .. B26D 1/626; B26D 7/10; B26F 3/08; B65B 61/10

USPC ..... 83/346, 16, 171

See application file for complete search history.

(56) References Cited

U.S. PATENT DOCUMENTS

| | | | | |
|---|---|---|---|---|
| 2,275,612 A * | 3/1942 | Chandler | ..... | B26F 1/24 264/156 |
| 2,748,863 A * | 6/1956 | Benton | ..... | B29C 67/00 83/171 |
| 3,056,323 A * | 10/1962 | Kwitek | ..... | B26F 1/20 83/342 |
| 3,086,416 A * | 4/1963 | Minarik | ..... | B26D 7/20 83/345 |

(Continued)

FOREIGN PATENT DOCUMENTS

| | | |
|---|---|---|
| EP | 0725007 A1 | 8/1996 |
| JP | S50-044587 A | 12/1975 |

(Continued)

*Primary Examiner* — Kenneth E Peterson

(74) *Attorney, Agent, or Firm* — Robert S. Lelkes

(57) ABSTRACT

The invention relates to a cutting device and method for cutting prefabricated transverse seal seams of a tube composed of plastic film and filled with food, particularly soft cheese, wherein each transverse seal seam of the continuously supplied film tube to be processed separates one portion of the food from the next portion. The device comprises a rotating knife holder provided with at least one knife blade 22, and wherein the knife blade 22 acts on a counter bearing 4 when cutting a transverse seal seam, wherein said knife holder has a heating element for heating the knife blade 22 in a targeted fashion.

11 Claims, 3 Drawing Sheets

(56) References Cited

U.S. PATENT DOCUMENTS 3,522,135 A 7/1970 Page
3,703,841 A * 11/1972 Crawford ..... B26D 1/0006 83/341
3,847,045 A * 11/1974 Willhite, Jr. ..... B26D 1/205 83/37
4,279,183 A * 7/1981 LaFleur ..... B26D 1/626 83/16
4,561,236 A 12/1985 Kreamer
4,691,606 A * 9/1987 Johnson ..... B26F 1/20 83/175
4,982,637 A * 1/1991 Osborn ..... B26D 1/405 83/346
5,313,863 A * 5/1994 Aihara ..... B26D 1/245 83/171
5,449,482 A * 9/1995 Faddar ..... B26D 7/1854 264/154
5,451,288 A * 9/1995 Smith ..... B26D 7/10 156/359
6,220,673 B1 4/2001 Russell et al.
6,588,477 B2 7/2003 Habeck et al.
6,592,703 B1 7/2003 Habeck et al.
6,651,539 B1 11/2003 Eicher et al.
2002/0000292 A1 1/2002 Habeck et al.
2002/0104413 A1* 8/2002 Adachi ..... B29C 67/0044 83/16
2002/0134485 A1 9/2002 Habeck et al.
2002/0144580 A1 10/2002 Aichele
2003/0175389 A1 9/2003 Shaposhnikov
2005/0109179 A1 5/2005 Behringer
2013/0210595 A1* 8/2013 Tilley ..... B26D 1/626 493/239

FOREIGN PATENT DOCUMENTS

JP S51-076889 U1 6/1976
JP S52-099584 U1 7/1977
JP S52-121489 A 10/1977
JP S62-176790 A 8/1987
JP H06-024421 A 2/1994
JP H11-059609 A 3/1999
JP H11-077586 A 3/1999
SU 1588643 A1 8/1990

* cited by examiner

CROSS-CUTTING DEVICE

CROSS-REFERENCE TO RELATED APPLICATIONS

This application is a divisional of U.S. non-provisional patent application Ser. No. 14/284,827 filed on May 22, 2014, now abandoned, which is a divisional of U.S. non-provisional patent application Ser. No. 12/532,713, now abandoned, which entered the U.S. national phase on Sep. 23, 2009, based on international patent application no. PCT/EP2008/052934 filed on Mar. 12, 2008, which claims priority based on German patent application no. 102007015624 filed on Mar. 29, 2007.

FIELD OF THE INVENTION

This invention relates to a cutting device for cutting pre-fabricated transverse seams of a plastic-film sleeve that is filled with food, in particular with processed cheese, whereby each transverse seam of the film sleeve to be processed and continuously fed separates one portion of the food from the next portion. The device according to the invention has a rotating knife holder equipped with at least one cutting blade, in particular in the form of a blade cylinder, whereby the cutting blade strikes against an opposing bearing, in particular a counter-rotating opposing roller, when cutting a transverse seam.

BACKGROUND OF THE INVENTION

Cutting devices are known from, for example, the production of individually packaged processed cheese slices. Such a process for production and the corresponding device are indicated in, for example, DE 42 04 357 A1. In this case, processed cheese is filled into a film sleeve that is sealed at a longitudinal seam, and this sleeve is then rolled flat and subsequently cooled. In this case, the cheese belt surrounded by film is cut into portions only after cooling ("cold squeezing") by the cheese being squeezed at cross strips and the film sleeve from which cheese is removed being sealed at these cross strips by exposure to the action of heat. With modern machines, this squeezing takes place as long as the cheese mass is still hot ("hot squeezing"). To make individual slices from this "chain" or this belt of slices attached to one another, the seams formed by the cross-seals that are several millimeters wide are cut through with the knife or knives of the cutting device. In this case, such cutting devices can be designed in the manner of guillotines. The use of blade cylinders, whose flexible cutting blades cut on the hardened surface of an opposing roller, has proven especially advantageous, however, whereby the chain of the individual slices is fed through the two rollers.

A drawback of the known cutting devices is that the cutting blades become blunt after a certain number of cuts and have to be replaced. This is due to the fact that the double-layer film, which in most cases consists of polypropylene and is about 50 micrometers thick, is relatively tough in the state to be cut. The blunting of the cutting blades affects the service life negatively and reduces the productivity of the machine. Moreover, the cutting blades that are to be replaced are a cost factor in and of themselves, to which the assembly process with the expensive adjustment is added.

The object of the invention is now to propose a cutting device that in a simple design, which makes possible a modular type of construction and a simple assembly, ensures an extended service life because of less use of the cutting blades.

This object of the invention is achieved by the present invention described below.

SUMMARY OF THE INVENTION

One aspect of the present invention is a cutting device for cutting pre-fabricated transverse seams of a plastic-film sleeve that is filled with food, whereby each transverse seam of the film sleeve to be processed and continuously fed separates one portion of food from the next portion, wherein the device comprises:

(a) a rotatable knife holder having an axis of rotation and equipped with at least one cutting blade and one receiving part per cutting blade to receive the cutting blade, whereby the cutting blade has a cutting edge parallel to the axis of rotation and wherein the cutting blade extends from the axis of rotation, (b) the cutting blade is mounted on the receiving part such that the cutting edge extends beyond the receiving part and (c) a rotatable roller having a roller surface located proximate to, and having an axis of rotation parallel to the axis of rotation of, the rotatable knife holder, wherein the receiving part comprises a heating element for heating the cutting blade and the rotatable knife holder and the rotatable roller are configured to cause the cutting edge of the cutting blade of the rotatable knife holder to strike the surface of the rotatable roller when the rotatable knife holder is rotated, whereby the surface of the rotatable roller (4) engages with, and bears against, the cutting blade such that only the cutting edge of the cutting blade and the rotatable roller roll off against each other during rotation of the rotatable knife holder.

Another aspect of the invention is a method for cutting pre-fabricated transverse seams of a plastic-film sleeve that is filled with food, whereby each transverse seam of the film sleeve to be processed and continuously fed separates one portion of the food from the next portion, the method comprising:

providing a cutting device having a rotatable knife holder having at least one cutting blade and a rotatable roller;

passing the plastic-film sleeve that is filled with food having pre-fabricated transverse seams between the rotatable knife holder and the rotatable roller;

heating said cutting blade with a heating element within said receiving part to a temperature between about 80° C. and about 130° C., which is lower than a melting temperature of the plastic-film sleeve;

rotating the rotatable knife holder so that the cutting blade moves in the same direction as the plastic-film sleeve when proximate to the plastic-film sleeve;

synchronizing contact between the cutting blade edge and the surface of the rotatable roller with the presence of a pre-fabricated transverse seam of the plastic-film sleeve at the same location; and striking against the surface of the rotatable roller with said cutting blade during rotation of the knife holder, whereby a pre-fabricated transverse seam of the plastic-film sleeve is cut by said cutting blade.

A further aspect of this invention is a method for cutting pre-fabricated transverse seams of a plastic-film sleeve that is filled with food, whereby each transverse seam of the film sleeve to be processed and continuously fed separates one portion of the food from the next portion, the method comprising:

providing a cutting device having a rotatable knife holder having at least one cutting blade and a rotatable opposing bearing wherein the rotatable knife holder and rotatable opposing bearing are configured so that the cutting blade strikes the rotatable opposing bearing when the rotatable knife holder is rotated;

passing the plastic-film sleeve that is filled with food having pre-fabricated transverse seams between the rotatable knife holder and the rotatable opposing bearing;

rotating the rotatable knife holder so that the cutting blade moves in the same direction as the plastic-film sleeve when proximate to the plastic-film sleeve;

synchronizing contact between the cutting blade edge and the surface of the rotatable roller with the presence of a pre-fabricated transverse seam of the plastic-film sleeve at the same location;

striking against the surface of the rotatable roller with said cutting blade during rotation of the knife holder, whereby a pre-fabricated transverse seam of the plastic-film sleeve is cut by said cutting blade, wherein the cutting blade is heated to a temperature between about 80° C. and about 130° C.

Further aspects of the invention are illustrated in the drawings and described in the following detailed description of the invention.

DETAILED DESCRIPTION OF THE INVENTION

Figure 1:
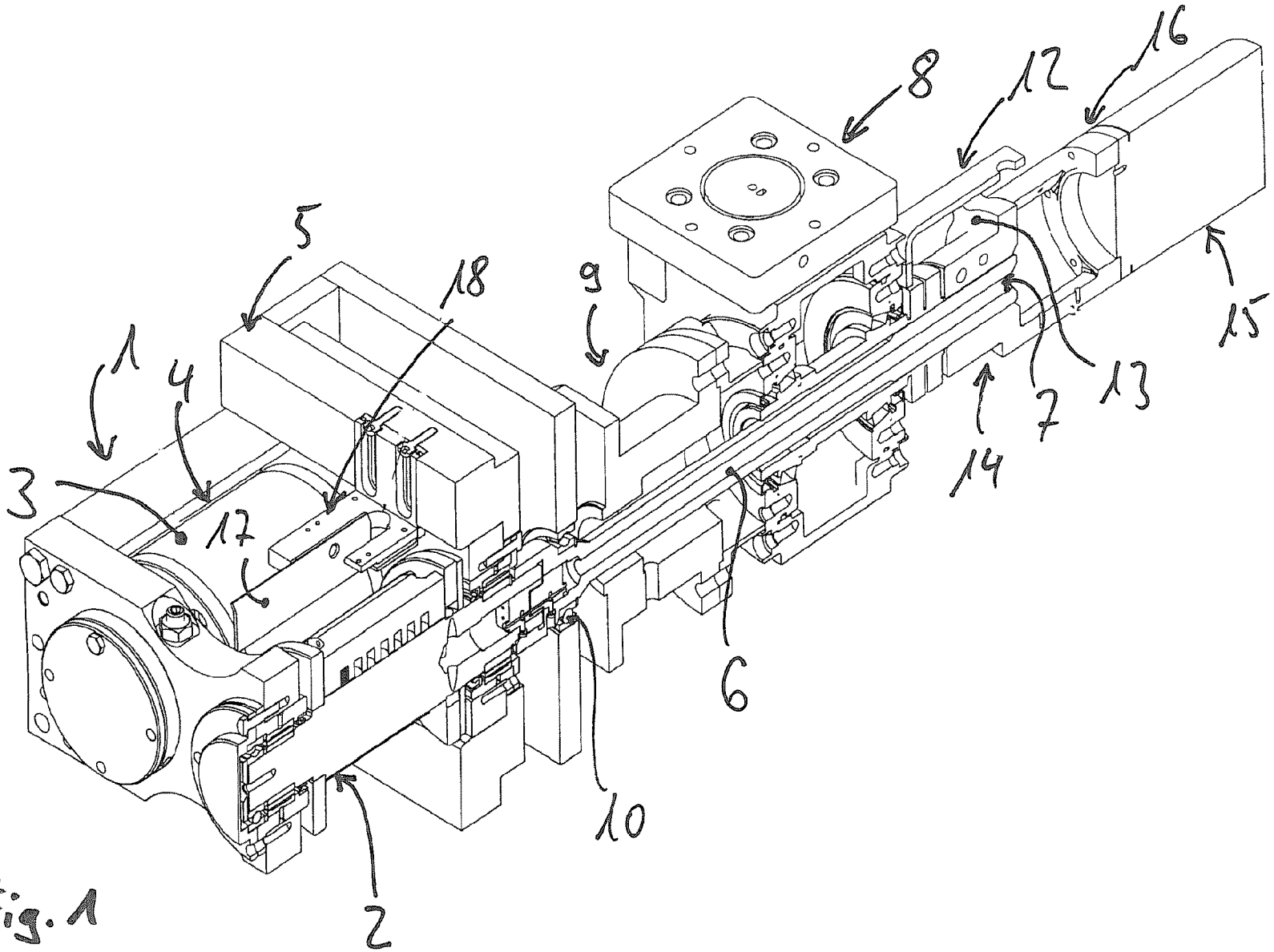
FIG. 1 shows a section through the cross-cutting device.

An essential idea of the invention is to provide the knife holder with a heating element, which causes a targeted heating of the cutting blades. In this case, as a "targeted heating of the cutting blades," such a heating is meant that goes beyond the normal operating temperature of the cutting blades and that primarily does not lead to a noteworthy heating of the knife holder, which because of heat expansion would irreversibly alter its geometry with respect to its smooth operation. In particular, the heating according to the invention is also not so great that the film at the transverse seam is opened by melting. The temperature of the cutting blade thus advantageously remains below the melting temperature of the plastic used for the film.

On this point, it can be emphasized that the procedure according to the invention is distinguished from the prior art, as it is disclosed in, for example, DE 39 20 867 A1. There, in a single operating step, the product is squeezed in the area of the sleeve that is to be cut, is transverse to this area and is cut here. The knife thus performs sealing and separating at the same time. At no point does the pre-fabricated transverse seam exist. Thus, this procedure, in the sleeve that is present here and filled with food, in particular with processed cheese, is not possible, since in the manufacturing procedure, first a chain of connected portions is formed and has to be fed to a cooling process. Only the thus pre-manufactured portions are then separated.

In the additional heating according to the invention, it is necessary to hold the latter as far as possible from the bearings. This object can be achieved in that the knife holder is designed so that the flow of heat is essentially sent to the cutting blades. This can be affected by the selection of material or the provision of insulation and/or the installation of a heat trap, for example in the form of cooling by a corresponding cooling device. It is especially advantageous, since it is especially simple to achieve, however, if the heating element is arranged near the cutting blade and with corresponding heat contact to the cutting blade in such a way that a large portion of the heat output is fed as directly as possible to the cutting blade and heats the latter more greatly than the remaining knife holder.

In general, the advantage of heating the cutting blade lies in the fact that the film sleeve that is locally heated for a short time resists the cutting blade when cutting a reduced resistance, so that the degree of wear and tear of the cutting blade is reduced and thus the service life of the cutting device is increased. Ultimately, the film sleeve that is formed from plastic film, for example polypropylene, is softer by the heating at the interface than it is at room temperature, so that it can be cut more easily. It has been shown that the service life of the cutting blades can be increased by a multiple in the method according to the invention. In this case, it has also been shown that it is advantageous when the heat output and the arrangement of the heating element are selected so that a temperature of over 80° C., in particular of about 100° C., is produced on the cutting edge of the cutting blade. Temperatures of up to 130° C. are not ruled out.

As a heating element, for example, a commercially available heating cartridge of sufficient size can be used that is held in a hole made in the knife holder and is supplied with voltage. The dimensioning of the heating cartridge and its voltage supply can be adapted according to the geometry of the knife holder. The heat output of the heating cartridges can be adapted to the application speed to obtain the desired temperature. Although the measurement of the current temperature by a corresponding sensor and also its controllability has a certain advantage, it is not absolutely necessary. Ultimately, the cutting device cuts "in emergency operation" even without a heated cutting blade.

Since it is structurally expensive to minimize undesirable heat expansions that change the position of the cutting blade and such changes occasionally cannot be completely avoided, it is especially advantageous when the cutting blade is held in a flexible manner on the knife holder, so that the cutting blade can be flexible in the cutting direction. In this case, the elasticity is adjusted so that a pressure that is adequate for the cutting action is maintained. The flexibility according to the invention can in this case be produced from the cutting blade itself or via an elastically suspended receiving part in which the cutting blade is held. Actually, the idea of the cross-cutting device with an elastically suspended cutting blade is, to a certain extent, independent of the knife holder with heating element according to the invention. However, special advantages arise specifically from the combination of the two ideas.

One advantage of such flexibility lies primarily in the associated increase in the tolerance of the cutting blade compared to a possible maladjustment, which can take place during operation. This advantage especially has an effect if the knife holder and the opposing bearing are designed as rollers, and the cutting blade during cutting has to be lined up exactly against the smooth and hardened surface of the opposing roller. In such an arrangement, any maladjustment produces a gap between the cutting blade and the surface of the opposing roller, so that the cut cannot be made completely. With the elastic suspension according to the invention, which advantageously also still allows a little play in other degrees of freedom, such a formation of gaps is avoided. As a result, the flexibility produces a certain tolerance against maladjustment, and even reduces the expense in the assembly of cutting blades.

With respect to an especially high production speed, it is advantageous if the knife holder is designed as a rotating means, in particular in the form of the already mentioned blade cylinder, whereby the latter is equipped in particular with several, advantageously with four, cutting blades. In the case of such a blade cylinder, it is then advantageous if the opposing bearing is formed from a counter-rotating opposing roller, which has, in particular, a surface made of hard metal. The opposing roller can have a somewhat different diameter from the blade cylinder. To eliminate another drive, it is especially advantageous if the blade cylinder drives the opposing roller over boundary areas that roll off on one another. With such a drive that has little slack or with a somewhat different roller diameter, the result is that the cutting blade does not always press down on the same spot on the opposing bearing, so that it results in a uniform use of the opposing bearing. Advantageously, the bearing of the opposing roller is also somewhat prestressed to produce the corresponding contact pressure and to offset tolerances.

In the case of such a blade cylinder, there are two advantageous possibilities of holding the cutting blades: in one case, the fastening for a cutting blade is implemented as a separate receiving part that is held in a radially-oriented guideway in the blade cylinder and is pressed down by springs. Such a design offers several possibilities relative to the adjustment parameters; the adjustment is still expensive because of the high number of parts. In an especially simple alternative, the material of the blade cylinder forms the actual support surfaces. The support surfaces are recessed to a certain extent in the material of the blade cylinder, whereby correspondingly adjusted support edges can be provided. The cutting blades then need to be put only on these support surfaces and be fastened. To obtain elasticity, the support surfaces are somewhat shorter than the cutting blades, so that the latter flex with their extension when held accordingly.

Advantageously, the cross-sealing during cutting is not completely separated, but rather perforated to a certain extent, so that after cutting, film arms remain, at which the chain adheres, and have to be conveyed a bit further on until the final separation of the individual links occurs. The final separation then takes place by, for example, tearing off, by the leading portion, in particular the cheese slice, being somewhat accelerated in comparison to the trailing portion. Such a "perforation" can be produced so that the cutting edge of the cutting blade is shorter than the transverse seam, so that during cutting, two arms remain on the edge. To achieve this perforation, grooves can also be ground into the cutting blades.

It is also especially advantageous if the blade cylinder and the opposing roller are combined in a common module that can be held on the machine and easily replaced. Such a module has the advantage that the cutting blades are preassembled and can be adjusted. To make possible the replaceability, the blade cylinder is equipped with an electrical connection arranged in the drive shaft, via which connection the supply lines of the heating element(s) can be put into contact with corresponding cables that run in the shaft.

The invention is explained in more detail below based on FIGS. 1 to 4.

The cut that is depicted in FIG. 1 by a cross-cutting device shows a cross-cut module 1 (see also FIG. 2) on its end, with a rotating blade cylinder 2 that is designed as a cross-cutting cylinder (shown in cut sections) and an opposing roller 4, whose surface 3 is coated with hard metal. The chain formed by the interconnecting cheese slices is run between the rollers from above past a guide plate 17. The cross-cut module 1 is screwed tightly into an assembly wall 5 of the machine. FIG. 1, moreover, shows the drive of the blade cylinder 2 over the drive shaft 6, and in this central hole 7, cables, not shown, are run for the supply of heating elements. The drive is actuated via a servomotor, not shown, which acts on the drive shaft 6 via the worm gear 8. The worm gear 8 is held on the assembly wall 5 via a spacer 9, whereby the drive shaft 6 is mounted on the assembly wall 5 via a ball bearing 10.

The end of the drive shaft 6 has a hole with a splined hub profile, into which a corresponding splined shaft profile 11 of the blade cylinder 2 (see FIG. 3) is inserted. On the housing of the worm gear 8, a holder 12 is provided for an initiator, which queries the cams 13 of the coupling 14 and thus defines the position of the cutting blades. The supply voltage for the heating elements is fed via a slip ring unit 15 and via the supply cables, not shown, of the blade cylinder 2. FIG. 1 also shows a light barrier system 18, with which the arrival of a transverse seam is detected. Corresponding to this arrival, the servomotor is controlled so that the cutting blades cut through the transverse seam in the center.

Figure 2:
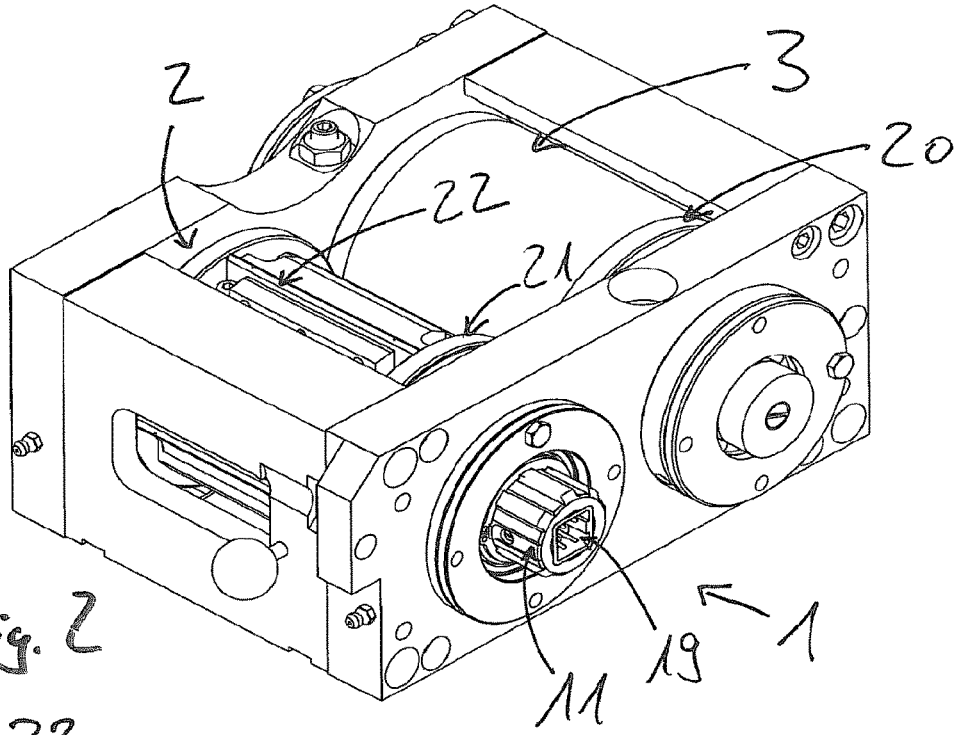
FIG. 2 shows a cross-cut module with a blade cylinder and an opposing roller.

In FIG. 2, a separate cross-cut module 1 is shown with a blade cylinder 2 and a counter-rotating opposing roller 3. The splined shaft profile 11 of the blade cylinder 2 and the electrical plug-in contact 19 contained therein can be seen. The connector to the drive shaft thus provides the mechanical and the electrical coupling of the cross-cut module 1 to the drive. With the connector, the complete cross-cut module can be removed from the unit and can be replaced by another module. The drive of the opposing roller 3 takes place via the edges 20 and 21 of the two rollers 2 and 3 that roll off on one another. FIG. 2 also shows one of four cutting blades 22, which are held on the blade cylinder 2.

Figure 3:
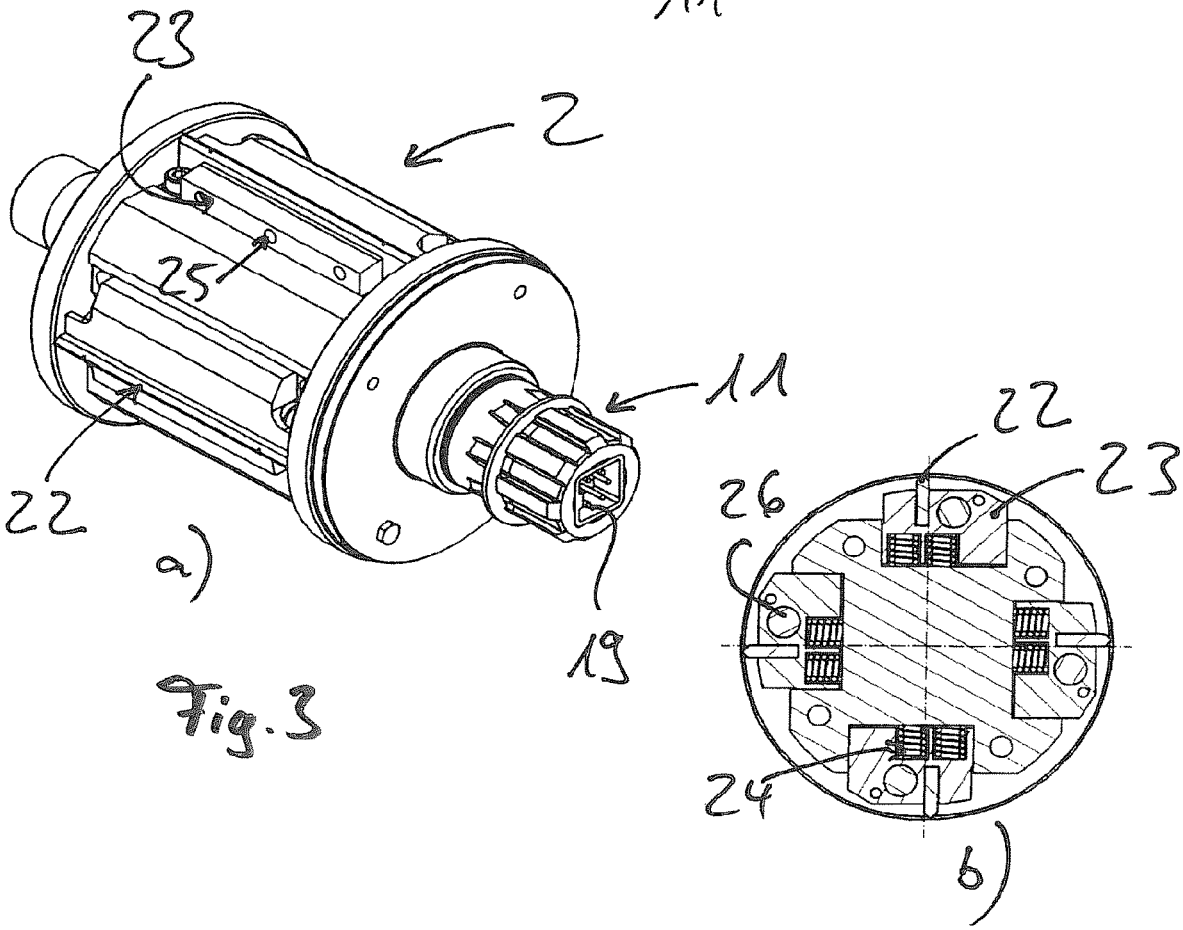
FIG. 3 shows a first embodiment of a blade cylinder.

Easier to see are the cutting blades 22 from FIG. 3, which shows a blade cylinder 2. In this embodiment, separate receiving parts 23 (FIG. 3*b*), which in each case hold a cutting blade 22 that extends over the entire active length of the blade cylinder 2, are arranged in the blade cylinder 2. The cutting blades 22 are held by screws 25 and adjusted in the receiving part. The receiving parts 23 in each case have a support surface on which the cutting blade rests over an extensive area and with good heat contact. They are run into a guideway that is introduced into the solid matter of the roller 2 and can be moved therein in radial direction. The receiving parts 23 are pressed down in radial direction by springs 24. The respective cutting blade is held elastically in cutting direction on the knife holder.

In FIG. 3*b*, holes 26 can be seen, and said holes 26 are made in the receiving parts 23 and in each case accommodate a heating element for specific heating of the cutting blade 22. In this way, the heating element is arranged in such a way that a majority of its heat output is fed to the cutting blade 22 and heats the latter more greatly than the knife holder.

Figure 4:
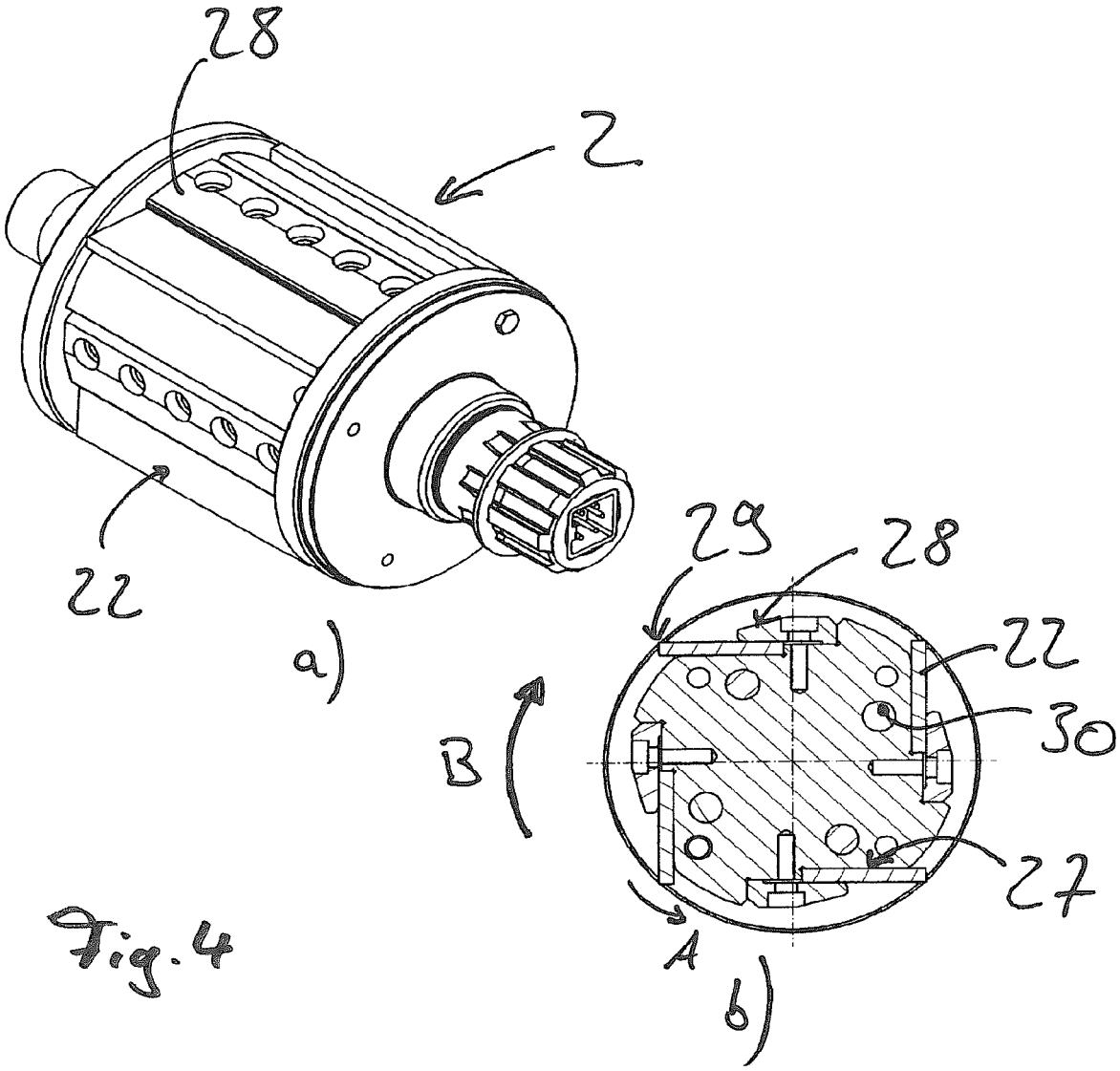
FIG. 4 shows a second embodiment of a blade cylinder.

In FIG. 4, another type of blade cylinder 2 is shown, which also has a splined-shaft profile 11 and a connector 19, which, however, has another type of attachment of the cutting blades 22. In particular, it can be seen from FIG. 4*b* that the cutting blades 22 in the plane of a secant are attached perpendicular to the radius of the roller. To this end, in the solid matter of the knife holder, support surfaces 27 are formed on which the large-area cutting blades 22 rest. They are applied to the application edges on the solid matter and are held by clamping claws 28 at their edge facing away from the cutting edge 29. In the material of the roller, in direct proximity to the support surfaces 27, holes 30 are made to hold the heating elements. The cutting edges 22 are formed from flat material made of hard metal with a rectangular cross-section, whereby the four edges of the flat material in each case form a cut edge. A cutting blade thus has four cuts. The flat material can also be made of HSS or powder-metallurgical material.

The elasticity of the cutting blades 22 is ensured by the fact that they are held on one side and that the support on the support surface 27 is incomplete. Because of this special holder, an elasticity in the direction of arrow A and thus also in radial cutting direction is provided. The direction of travel is identified with arrow B.

The following is a summary of certain preferred aspects of the invention:

1. Cutting device for cutting pre-fabricated transverse seams of a plastic-film sleeve that is filled with food, in particular with processed cheese, whereby each transverse seam of the film sleeve to be processed and continuously fed separates one portion of the food from the next portion, whereby the device has a rotating knife holder equipped with at least one cutting blade (22), and whereby the cutting blade (22) strikes against an opposing bearing (4) when cutting a transverse seam, characterized in that the knife holder has a heating element for targeted heating of the cutting blade (22).
2. Cutting device, according to paragraph 1, wherein the heating element is arranged in such a way that a majority of its heat output is fed to the cutting blade (22) and heats the latter more greatly than the knife holder.
3. Cutting device according to paragraph 1, wherein the cutting blade (22) is held elastically on the knife holder in the cutting direction.
4. Device according to paragraph 1, wherein the knife holder is a blade cylinder (2), which is equipped with several, in particular with four, cutting blades (22), whereby a counter-rotating opposing roller (4) forms the opposing bearing.
5. Cutting device according to paragraph 1, wherein the cutting blade (22) rests on a support surface, whereby the heating element is arranged in a hole (30) of the solid material that forms the support surface.
6. Cutting device according to paragraph 5, characterized by a separate receiving part (23) for holding in each case a cutting blade (22), which is held in a radially oriented guideway of the knife holder and is pressed down by springs (24).
7. Cutting device according to paragraph 5, characterized by the fact that the material of the knife holder forms the support surface (27), whereby the support surface (27) is oriented in particular outside of the radials of the blade cylinder (2).
8. Cutting device according to paragraph 7, wherein the cutting blade (22) is formed by a flat material, in particular made of hard metal, with a rectangular cross-section, whereby the four edges of the flat material in each case form a cutting edge (29).
9. Cutting device according to one of the preceding paragraphs, wherein the heating element produces a temperature on the cutting edge (29) of the cutting blade of over 80° C., in particular of about 100° C.
10. Cutting device according to one of the preceding paragraphs, wherein the knife holder is provided with a sensor to measure temperature and/or with a cooling system.
11. Cutting device according to one of the preceding paragraphs, wherein the cutting edge (29) of the cutting blade (22) is such that in particular it is shorter than the transverse seam, so that after cutting, film arms remain or a perforation seam is produced.

What is claimed is:

1. A cutting device for cutting pre-fabricated transverse seams of a plastic-film sleeve that is filled with food, whereby each transverse seam of the film sleeve to be processed and continuously fed separates one portion of food from the next portion, wherein the device comprises:

(a) a rotatable cutting blade holder having an axis of rotation, (b) at least one cutting blade having a length comprising a cutting edge and a flat rectangular cross-section comprising a width and a thickness, wherein the width is greater than the thickness and the width is capable of elastically flexing in response to a force and (c) a rotatable roller having a roller surface located proximate to the rotatable cutting blade holder and an axis of rotation parallel to the axis of rotation of the rotatable cutting blade holder, wherein the rotatable cutting blade holder comprises:

(a) (1) one flat support surface per cutting blade, wherein the flat support surface has a length aligned with the axis of rotation of the cutting blade holder accommodating the length of the cutting blade and a width extending in a nonradial transverse direction relative to the axis of rotation of the rotatable cutting blade holder and (2) at least one clamping device mounted on the rotatable cutting blade holder for clamping the cutting blade onto the flat support surface, and (b) at least one heating element per flat support surface positioned between the flat support surface and the axis of rotation of the rotatable cutting blade holder, wherein a first portion of the width of the cutting blade is clamped onto the flat support surface via the at least one clamping device, whereby the cutting edge of the cutting blade is fixed in a position parallel to the axis of rotation of the rotatable roller, and a second portion of the cutting blade comprising the cutting edge of the cutting blade projects beyond the flat support surface, wherein the first portion is greater than the second portion, the heating element is capable of applying heat to the first portion of the width of the cutting blade via contact between the first portion of the width of the cutting blade and the flat support surface, the rotatable cutting blade holder and the rotatable roller are configured to cause the cutting edge of each cutting blade of the rotatable cutting blade holder to strike the surface of the rotatable roller when the rotatable cutting blade holder is rotated, whereby the surface of the rotatable roller (4) engages with, and bears against, the cutting edge of each cutting blade during rotation of the rotatable cutting blade holder, whereby each cutting blade undergoes flexing along the width of the cutting blade in response to the engagement with the surface of the rotatable roller (4) and each cutting blade is capable of striking the roller surface of the rotatable roller at different locations on the roller surface when the knife holder is rotated about its axis of rotation.

2. The cutting device according to claim 1, wherein the rotatable cutting blade holder is equipped with multiple cutting blades corresponding to the cutting blade, multiple flat support surfaces corresponding to the flat support surface and multiple clamping devices corresponding to the clamping device, wherein the first portion of the width of each of the cutting blades is clamped against the flat support surface of one of the flat support surfaces by at least one of the clamping devices.

3. The cutting device according to claim 1, wherein the rotatable cutting blade holder comprises a hole for a heating element and the heating element is arranged in the hole.

4. The cutting device according to claim 1, wherein each flat support surface is integrated in the rotatable cutting blade holder.

5. The cutting device according to claim 1, wherein the clamping device is a clamping claw mounted on the rotatable cutting blade holder for clamping the cutting blade against the flat support surface.

6. The cutting device according to claim 4, wherein the rotatable cutting blade holder has a splined shaft cross-sectional profile and comprises clamping claws for clamping each cutting blade onto the rotatable cutting blade holder such that each cutting blade is in the plane of a secant relative to the surface of the rotatable roller.

7. The cutting device according to claim 1, wherein the rotatable cutting blade holder and the rotatable bearing roller each have a boundary area, wherein the boundary area of the rotatable cutting blade holder is in rotatable engagement with the boundary area of the rotatable bearing roller, wherein the boundary area of the rotatable roller has a diameter that is different from the diameter of boundary area of the rotatable cutting blade holder, whereby engagement between the rotatable roller and the rotatable cutting blade holder during rotation causes the rotatable roller to rotate at a rate that is different from the rate of rotation of the rotatable cutting blade holder.

8. The cutting device according to claim 7, wherein the rotatable cutting blade holder has a first end and a second end distal from the first end in the axial direction and the boundary area of the rotatable cutting blade holder comprises a first annular edge (21) at the first end of the rotatable cutting blade holder capable of driving the rotation of the rotatable roller via engagement of the first edge with the rotatable roller.

9. The cutting device according to claim 8, wherein the rotatable roller has a first end and a second end distal from the first end of the rotatable roller in the axial direction, wherein the first end of the rotatable roller is proximal to the first end of the rotatable cutting blade holder and comprises a first annular edge (20) which is drivably engaged with the first annular edge (21) of the rotatable cutting blade holder.

10. The cutting device according to claim 8, wherein the second end of the rotatable cutting blade holder comprises a second annular edge capable of driving rotation of the rotatable roller via engagement of the second edge with the rotatable roller.

11. The cutting device according to claim 1, wherein the rotatable cutting blade holder is provided with a sensor to measure temperature and/or with a cooling system.

* * * * *